US010069204B2

(12) United States Patent
Kim et al.

(10) Patent No.: US 10,069,204 B2
(45) Date of Patent: Sep. 4, 2018

(54) ANTENNA DEVICE AND ELECTRONIC DEVICE

(71) Applicant: Samsung Electronics Co., Ltd., Suwon-si, Gyeonggi-do (KR)

(72) Inventors: Gyu Sub Kim, Seoul (KR); Yeon Woo Kim, Seoul (KR); Se Hyun Park, Suwon-si (KR); Jae Bong Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 35 days.

(21) Appl. No.: 14/820,107

(22) Filed: Aug. 6, 2015

(65) Prior Publication Data

US 2016/0049734 A1 Feb. 18, 2016

(30) Foreign Application Priority Data

Aug. 14, 2014 (KR) ..... 10-2014-0106058

(51) Int. Cl.

| | |
|---|---|
| ***H01Q 9/04*** | (2006.01) |
| ***H01Q 5/371*** | (2015.01) |
| ***H01Q 21/28*** | (2006.01) |
| ***H01Q 1/24*** | (2006.01) |
| ***H01Q 13/10*** | (2006.01) |
| ***H01Q 13/16*** | (2006.01) |

(52) U.S. Cl.

CPC ..... *H01Q 9/0421* (2013.01); *H01Q 1/243* (2013.01); *H01Q 5/371* (2015.01); *H01Q 13/10* (2013.01); *H01Q 13/16* (2013.01); *H01Q 21/28* (2013.01)

(58) Field of Classification Search

CPC ..... H01Q 9/0421; H01Q 13/10; H01Q 13/16

See application file for complete search history.

(56) References Cited

U.S. PATENT DOCUMENTS

| | | | | |
|---|---|---|---|---|
| 6,133,879 | A * | 10/2000 | Grangeat | H01Q 1/24 343/700 MS |
| 8,090,423 | B2 | 1/2012 | Na et al. | |
| 8,134,507 | B2 | 3/2012 | Chen et al. | |
| 9,318,793 | B2 * | 4/2016 | Zhu | H01Q 1/243 |
| 2004/0085244 | A1 | 5/2004 | Kadambi et al. | |
| 2004/0257283 | A1 * | 12/2004 | Asano | H01Q 1/243 343/702 |
| 2006/0077113 | A1 | 4/2006 | Yuanzhu | |
| 2007/0247386 | A1 | 10/2007 | Lee et al. | |
| 2010/0137042 | A1 | 6/2010 | Na et al. | |
| 2010/0141535 | A1 | 6/2010 | Chen et al. | |
| 2012/0280876 | A1 * | 11/2012 | Qu | H01Q 1/243 343/767 |
| 2013/0082884 | A1 | 4/2013 | Gummalla | |
| 2013/0244739 | A1 | 9/2013 | Arkko et al. | |
| 2014/0097997 | A1 | 4/2014 | Chang | |

(Continued)

FOREIGN PATENT DOCUMENTS

| | | | |
|---|---|---|---|
| EP | 2 518 830 | A1 | 10/2012 |
| GB | 655045 | A | 7/1951 |

*Primary Examiner* — Robert Karacsony

(74) *Attorney, Agent, or Firm* — Jefferson IP Law, LLP

(57) ABSTRACT

An antenna device is provided. The antenna device includes a base plate of a conductive material, at least one slit disposed in at least one area of the base plate and having a form in which a portion of a closed curve is open, and a feeding part configured to supply current to an inner area surrounded by the slit.

13 Claims, 12 Drawing Sheets

(56) References Cited

U.S. PATENT DOCUMENTS

| | | | | |
|---|---|---|---|---|
| 2014/0184450 | A1 | 7/2014 | Koo et al. | |
| 2014/0218250 | A1 | 8/2014 | Kim et al. | |
| 2015/0270619 | A1* | 9/2015 | Zhu | G01V 3/00 343/702 |

* cited by examiner

ANTENNA DEVICE AND ELECTRONIC DEVICE

CROSS-REFERENCE TO RELATED APPLICATION(S)

This application claims the benefit under 35 U.S.C. § 119(a) of a Korean patent application filed on Aug. 14, 2014 in the Korean Intellectual Property Office and assigned Serial number 10-2014-0106058, the entire disclosure of which is hereby incorporated by reference.

TECHNICAL FIELD

The present disclosure relates to an antenna device included in an electronic device and an electronic device using an antenna device.

BACKGROUND

Wireless communication electronic devices are becoming one of the most essential electronic devices in our lives. Wireless communication electronic devices may include an antenna device for performing wireless communication.

As electronic devices become multi-functional, antenna devices capable of performing various functions are under development. Recently, a metallic antenna to protect an electronic device and also be disposed at the outer surface of an electronic device to have a distinctive design is under development.

A metallic antenna disposed at the outer surface of an electronic device may secure the rigidity of an electronic device or have a design advantage, but if most of the outer surface of a mobile phone is formed of a conductive material (for example, metallic material), the antenna performance may be reduced. For example, when the entire external conductive area is used as an antenna, it is difficult to obtain a resonance frequency band. If a portion of an external conductive area is used as an antenna, it is difficult to ensure antenna performance due to the physical and electrical characteristics of a conductive material that affects radiation performance.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device configured to maximize an external conductive area of an electronic device and secure the antenna performance (for example, resonance frequency band or radiation performance).

In accordance with an aspect of the present disclosure, an antenna device is provided. The antenna device includes a base plate of a conductive material, at least one slit disposed in at least one area of the base plate and having a form in which a portion of a closed curve is open, and a feeding part configured to supply current to an inner area surrounded by the slit.

In accordance with another aspect of the present disclosure, an antenna device is provided. The antenna device includes a base plate of a conductive material including a penetration area, a radiator configured to be inserted into the penetration area and being spaced apart from the base plate, a connection part configured to connect the base plate and the radiator, and a feeding part configured to supply current to the radiator.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figures 1A, 1B, 1C:
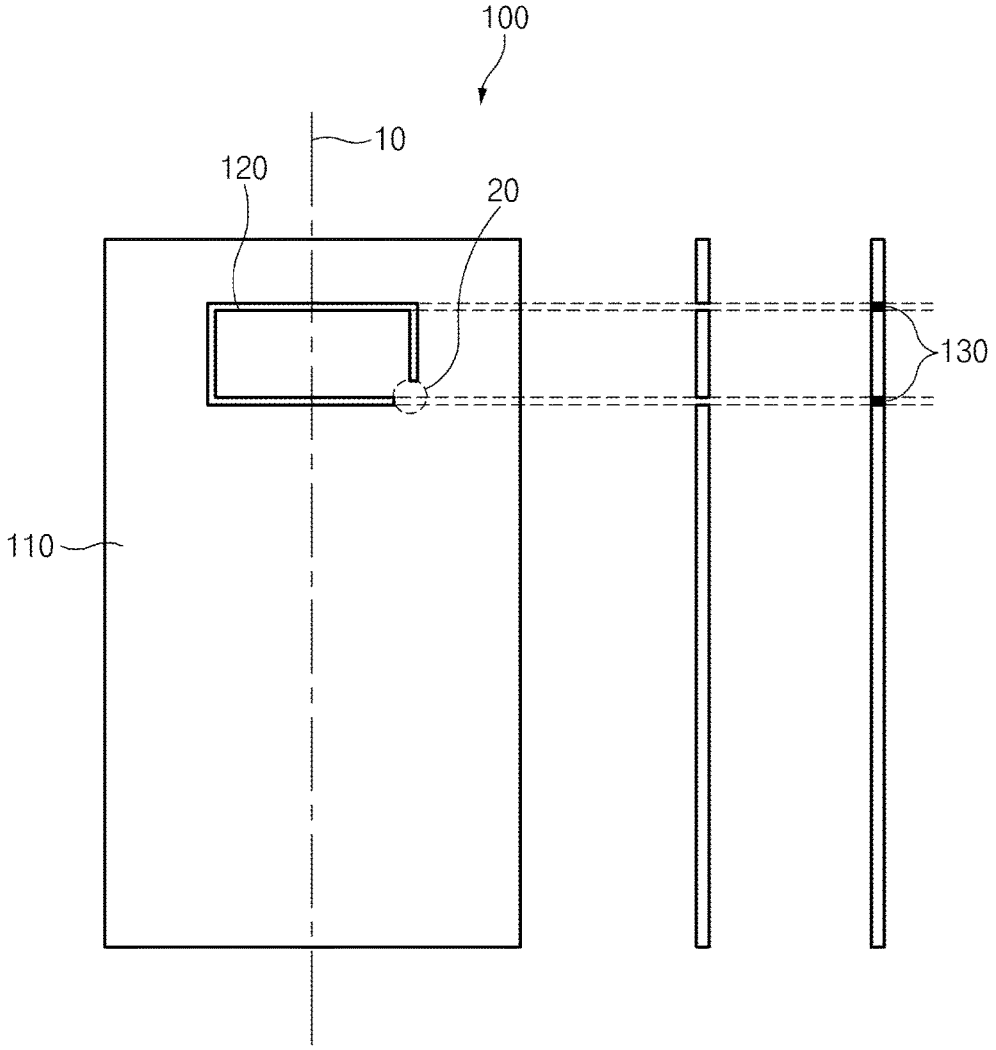
FIGS. 1A, 1B, and 1C are views illustrating a structure of an antenna device according to various embodiments of the present disclosure.

FIGS. 1A, 1B, and 1C are views illustrating a structure of an antenna device according to various embodiments of the present disclosure.

Referring to FIG. 1A, an antenna device 100 according to various embodiments of the present disclosure may include a base plate 110, at least one slit 120, and filler 130.

According to an embodiment of the present disclosure, the base plate 110 may be implemented with a conductive material (for example, a metallic material). According to an embodiment of the present disclosure, the base plate 110 may include at least one slit 120 therein. According to an embodiment of the present disclosure, the slit 120 may be filled with a filler 130. According to an embodiment of the present disclosure, the filler 130 may be a nonconductive material.

Referring to FIG. 1A, a plan view of the base plate 110 is illustrated. The base plate 110 may include the slit 120 therein (or, at least one area). As shown in FIG. 1A, the slit 120 may have a form in which a portion of a closed curve is open. The base plate 110 may be connected to a slit inside area by an open portion 20 without disconnection. According to an embodiment of the present disclosure, the slit 120 may be implemented in various forms such as polygons, circles, and ellipses in addition to a rectangular form as shown in FIG. 1A.

Referring to FIG. 1B, a sectional view taken along a line 10 of the base plate 110 shown in FIG. 1A is illustrated. The base plate 110 may have a predetermined thickness and a section of the base plate 110 may be shown in a separated form by the slit 120.

Referring to FIG. 1C, a sectional view taken along the line 10 of the base plate 110 shown in FIG. 1A is illustrated. According to an embodiment of the present disclosure, as shown in FIG. 1C, the slit 120 may be filled with the filler 130. According to an embodiment of the present disclosure, the filler 130 may be a nonconductive material. According to an embodiment of the present disclosure, if there is no filler 130, air may be a nonconductive material corresponding to the filler 130.

FIGS. 2A, 2B, 2C, and 2D are views illustrating a structure of an antenna device according to various embodiments of the present disclosure.

Referring to FIGS. 2A, 2B, 2C, and 2D, the antenna device 100 according to various embodiments of the present disclosure may include a base plate 110, a radiator 150, and a connection part 160.

According to an embodiment of the present disclosure, the base plate 110 may be implemented with a conductive material (for example, a metallic material). According to an embodiment of the present disclosure, the base plate 110 may include a penetration area. The radiator 150 may be inserted into the penetration area, while being spaced apart from the base plate 110. The connection part 160 may connect the base plate 110 and the radiator 150. According to an embodiment of the present disclosure, the filler 130 may be a nonconductive material to electrically insulate the radiator 150.

Figures 2A, 2B, 2C, 2D:
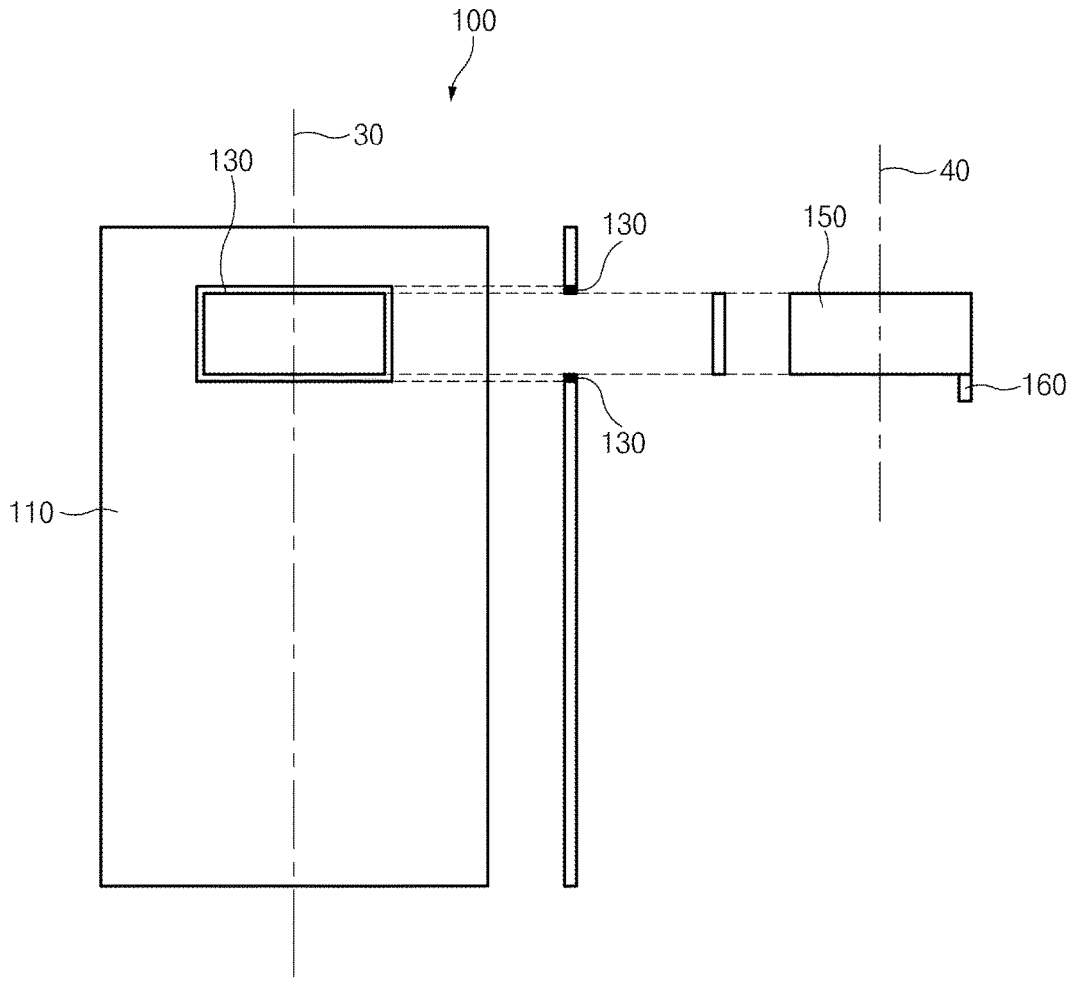
FIGS. 2A, 2B, 2C, and 2D are views illustrating a structure of an antenna device according to various embodiments of the present disclosure.

Referring to FIG. 2A, a plan view of the base plate 110 is illustrated. Referring to FIG. 2A, the base plate 110 may include the penetration area therein (or, at least one area). According to an embodiment of the present disclosure, the penetration area may be implemented in various forms such as polygons, circles, and ellipses in addition to a rectangular form as shown in FIG. 2A. According to an embodiment of the present disclosure, the filler 130 may be a nonconductive material.

Referring to FIG. 2B, a sectional view taken along a line 30 of the base plate 110 in FIG. 2A is illustrated. Referring to FIG. 2B, the base plate 110 may have a predetermined thickness and a section of the base plate 110 may be shown in a separated form by the penetration area.

Referring to FIG. 2D, a plan view of the radiator 150 and the connection part 160 is illustrated. The connection part 160 may extend from an edge of the radiator 160. When the radiator 150 is inserted into the penetration area, the connection part 160 may be connected to the base plate 110. According to an embodiment of the present disclosure, the radiator 150 may be formed at a layer (for example, the body of an electronic device) that is physically separated from the base plate 110.

Referring to FIG. 2C, a sectional view taken along a line 40 of the radiator 150 is illustrated.

Referring to FIGS. 2A to 2D, the radiator 150 may be inserted into the penetration area formed at the base plate 110, being spaced apart by a predetermined interval from the base plate 110. Referring to FIGS. 2A and 2B, a space between the base plate 110 and the radiator 150 may be filled with the filler 130. According to an embodiment of the present disclosure, the filler 130 may be a nonconductive material. According to an embodiment of the present disclosure, if there is no filler 130, air may be a nonconductive material corresponding to the filler 130.

The antenna device shown in FIGS. 2A, 2B, 2C, and 2D corresponds to an embodiment in which the slit 120 is formed in a closed curve formed to omit the open portion 20 and the connection part 160 performs the same function as the open portion 20. Accordingly, except for the above structural difference, description for the antennal 100 shown in FIGS. 1A, 1B, and 1C may be identically applied to the antenna device shown in FIGS. 2A to 2D.

Figure 3:
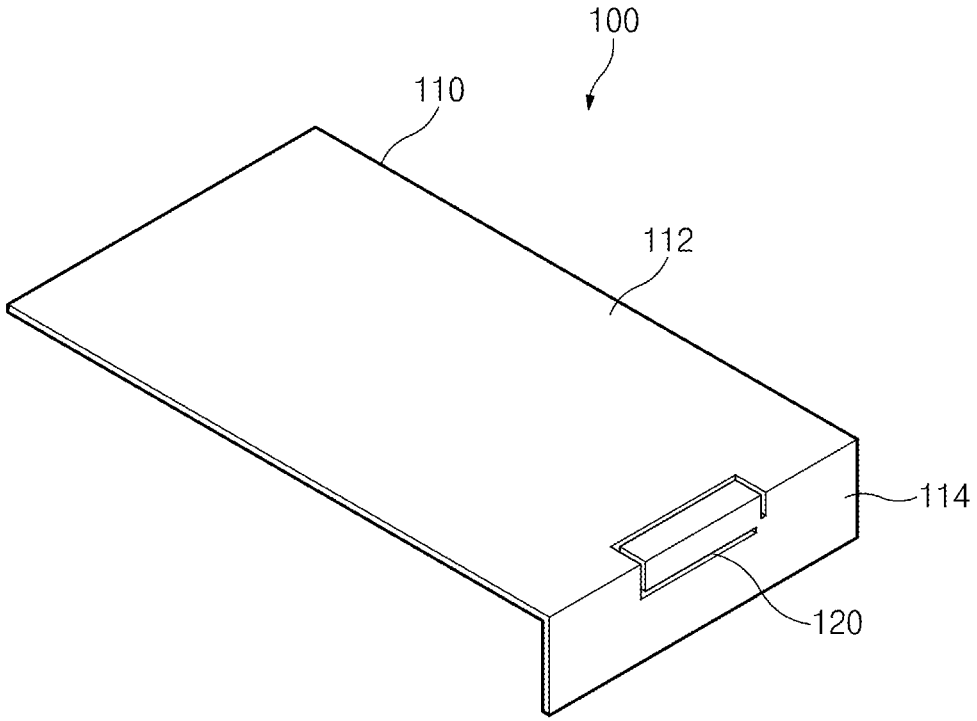
FIG. 3 is a view illustrating a structure of a base plate according to various embodiments of the present disclosure.

FIG. 3 is a view illustrating a structure of a base plate according to various embodiments of the present disclosure.

Referring to FIG. 3, the base plate 110 may include a first surface 112 and a second surface 114 extending bent from the first surface 112. For example, as shown in FIG. 3, when the first surface 112 is rectangular, the second surface 114 may extend from one of the surfaces forming the rectangle.

According to an embodiment of the present disclosure, when the antenna device 100 is included in an electronic device, the first surface 112 may be the bottom surface of the electronic device and the second surface 114 may be one side surface of the electronic device.

According to an embodiment of the present disclosure, the first surface 112 or the second surface 114 may be implemented in various forms (for example, a polygonal shape, a round edge of a polygonal shape, an oval shape, and so on).

According to an embodiment of the present disclosure, the first surface 112 or the second surface 114 may be implemented with a flat or curved surface. According to an embodiment of the present disclosure, a partial area of the first surface 112 or the second surface 114 may be implemented with a flat surface and the remaining area may be implemented with a curved surface. According to an embodiment of the present disclosure, the second surface 114 may extend from the first surface 112, forming various angles with the first surface 112. For example, referring to FIG. 3, the first surface 112 and the second surface 114 may be vertical to each other. In another example, the second surface 114 may extend in a curved form from the first surface 112 so that as it is distal from the first surface 112, and an angle formed between the second surface 114 and the first surface may be changed gradually.

According to an embodiment of the present disclosure, at least one slit 120 formed at the base plate 110 may be formed over the first surface 112 and the second surface 114. Referring to FIG. 3, the slit 120 may be continuously formed at the first surface 114 extending from the first surface 112. According to an embodiment of the present disclosure, an open area of the slit 120 may be formed at one of the first surface 112 and the second surface 114 or may be formed at a point where the first surface 112 and the second surface 114 meet each other.

Figure 4:
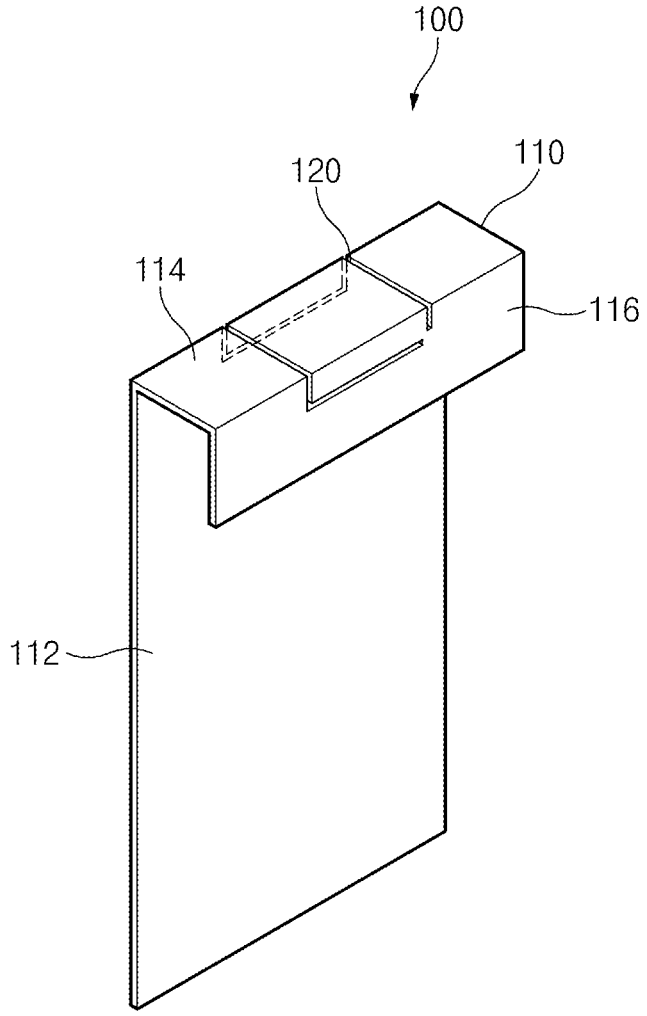
FIG. 4 is a view illustrating a structure of a base plate according to various embodiments of the present disclosure.

FIG. 4 is a view illustrating a structure of a base plate according to various embodiments of the present disclosure.

Referring to FIG. 4, a base plate 110 may include a first surface 112, a second surface 114 extending bent from the first surface 112, and a third surface 116 extending bent from the second surface 114. For example, as shown in FIG. 4, when the first surface 112 is rectangular, the second surface 114 may extend from one of the surfaces forming the rectangle and the third surface 116 may extend from the second surface 114 in a direction that is different from a direction that the second surface 114 extends.

According to an embodiment of the present disclosure, the first surface 112 and the second surface 116 may be implemented facing each other. For example, referring to FIG. 3, the first surface 112 and the third surface 116 may be parallel to each other.

According to an embodiment of the present disclosure, when the antenna device 100 is included in an electronic device, the first surface 112 may be the bottom surface of the electronic device, the second surface 114 may be one side surface of the electronic device, and the third surface 116 may be the front surface (for example, a display surface) of the electronic device. According to an embodiment of the present disclosure, when the third surface 116 corresponds to the front surface of the electronic device, at least a portion of the third surface 116 may be implemented in a form of being built in a display or lower part of a bezel.

According to an embodiment of the present disclosure, the first surface 112, the second surface 114, and the third surface 116 may be implemented in various forms (for example, a polygonal shape, a round edge of a polygonal shape, an oval shape, and so on).

According to an embodiment of the present disclosure, the first surface 112, the second surface 114, or the third surface 116 may be implemented with a flat (i.e., planar) or curved (i.e., non-planar) surface. According to an embodiment of the present disclosure, a partial area of the first surface 112, the second surface 114, or the third surface 116 may be implemented with a flat surface and the remaining area may be implemented with a curved surface. According to an embodiment of the present disclosure, the first surface 112, the second surface 114, and the third surface 116 may form various angles with each other. For example, referring to FIG. 3, the second surface 114 may be vertical to the first surface 112 and the third surface 116. In another example, the first surface 112 and the third surface 116 face each other and the second surface 114 has a curved surface. As the second surface 114 becomes far away from the third surface 116, an angle may be changed gradually.

According to an embodiment of the present disclosure, at least one slit 120 formed at the base plate 110 may be formed over the first surface 112, the second surface 114, and the third surface 116. Referring to FIG. 3, the slit 120 may be continuously formed from the first surface 112 to the third surface 116, crossing over the second surface 114. According to an embodiment of the present disclosure, an open area of the slit 120 may be formed at one of the first surface 112, the second surface 114, and the third surface 116 or may be formed at a point where the first surface 112, the second surface 114, and the third surface 116 meet each other.

Figure 5:
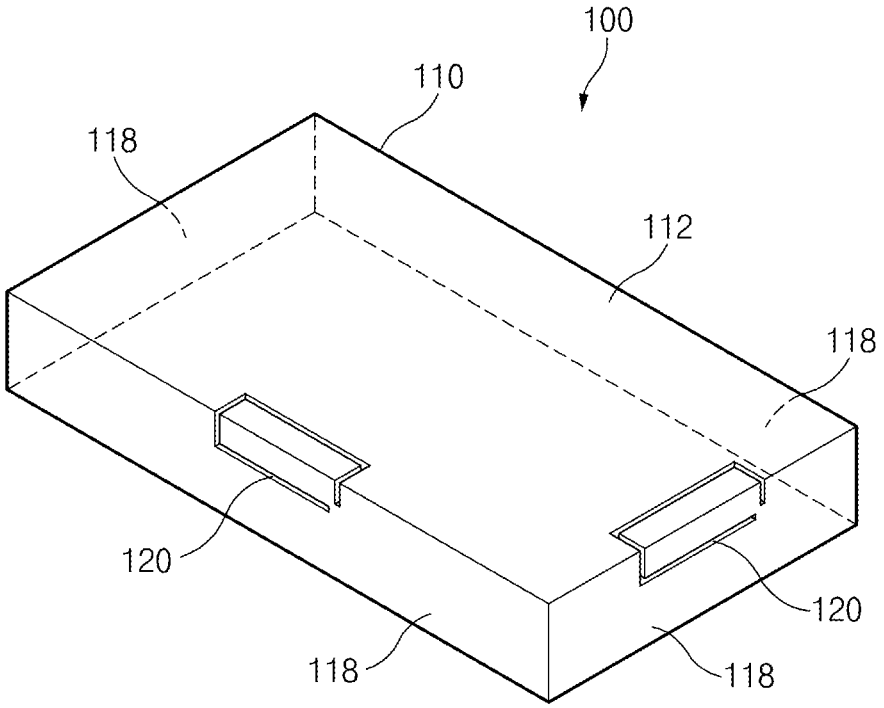
FIG. 5 is a view illustrating a structure of a base plate according to various embodiments of the present disclosure.

FIG. 5 is a view illustrating a structure of a base plate according to various embodiments of the present disclosure.

Referring to FIG. 5, the base plate 110 may include a first surface 112 and a first sidewall 118 extending from an edge of the first surface 112. For example, as shown in FIG. 5, when the first surface 112 is rectangular, the sidewall 118 may be four surfaces extending from each respective side of the first surface 112.

According to an embodiment of the present disclosure, when the antenna device 100 is included in an electronic device, the first surface 112 may be the bottom surface of the electronic device and the sidewall 118 may be the side surface of the electronic device.

According to an embodiment of the present disclosure, the first surface 112 or the sidewall 118 may be implemented with a flat or curved surface. According to an embodiment of the present disclosure, a partial area of the first surface 112 or the sidewall 118 may be implemented with a flat surface and the remaining area may be implemented with a curved surface. According to an embodiment of the present disclosure, the sidewall 118 may extend from the first surface 112, forming various angles with the first surface 112. For example, referring to FIG. 5, the first surface 112 and the sidewall 118 may be vertical to each other. For another example, the sidewall 114 may extend in a curved form from the first surface 112 so that as the sidewall 114 extends away from the first surface 112, an angle may be changed gradually.

According to an embodiment of the present disclosure, the base plate 110 may include a plurality of slits (for example, two or more). For example, referring to FIG. 5, the base plate 110 may include two slits 120 that are partially disposed on different sidewalls 118.

According to an embodiment of the present disclosure, at least one slit 120 formed at the base plate 110 may be formed over the first surface 112 and a portion of the sidewall 118. For example, referring to FIG. 5, the plurality of slits 120 may be continuously formed at the first surface 112 and the sidewall 118. According to an embodiment of the present disclosure, an open area of the slit 120 may be formed at one of the first surface 112 and the sidewall 118 or may be formed at a point where the first surface 112 and the sidewall 118 meet each other.

According to an embodiment of the present disclosure, the base plate 110 may include at least one slit 120 formed in at least one area. According to an embodiment of the present disclosure, at least one slit 120 may have a form in which a portion of a closed curve is open.

At least one slit 120 formed at the base plate 110 may be implemented in a variety of number or forms according to various embodiments of the present disclosure. According to an embodiment of the present disclosure, when the base plate 110 includes a plurality of slits, at least one of the form, size, and open portion position of each slit may be different.

According to an embodiment of the present disclosure, a plurality of slits may be separated from each other or some of them may be connected. According to an embodiment of the present disclosure, some of a plurality of slits may be connected to each other and the remaining may be separated. According to an embodiment of the present disclosure, the antenna device 100 may obtain multi-band or broadband characteristics according to the number or shape of the slits 120.

Figure 6A:
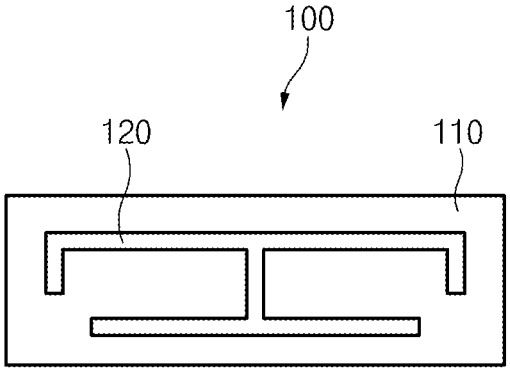
FIGS. 6A, 6B, 6C, and 6D are views illustrating various slits according to various embodiments of the present disclosure.

FIG. 6A. 6B, 6C, and 6D are views illustrating various slits according to various embodiments of the present disclosure.

Figure 6B:
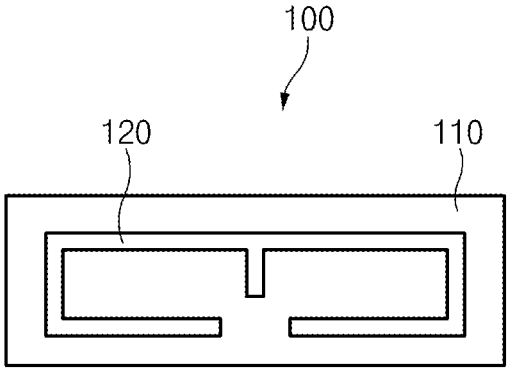

Referring to FIGS. 6A and 6B, a plurality of slits 120 can be connected. The slits 120 may be symmetric to each other with respect to an axis. According to an embodiment of the present disclosure, open portions of a slit 120 may be symmetric with respect to an axis. For example, open portions are formed to face each other in the opposite direction as shown in FIG. 6A, or opened portions are formed to face each other as shown in FIG. 6B.

Figure 6C:
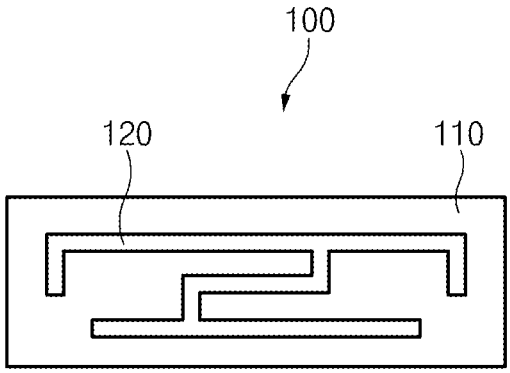
Figure 6D:
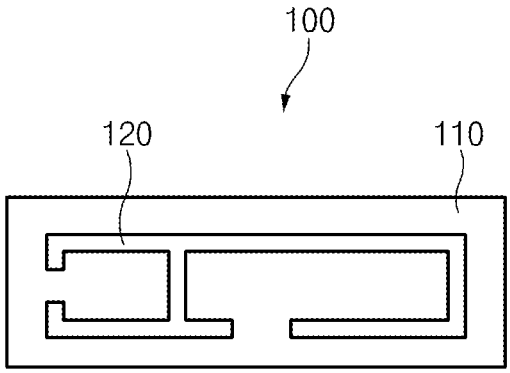

Referring to FIG. 6C, one of a plurality of slits 120 may be rotated 180° with respect to another slit 120. Referring to FIG. 6D, the forms of a plurality of slits 120 or the size of an inner area may be formed different from each other. Referring to FIG. 6D, a plurality of slits 120 may have open portions in different directions.

Figure 7:
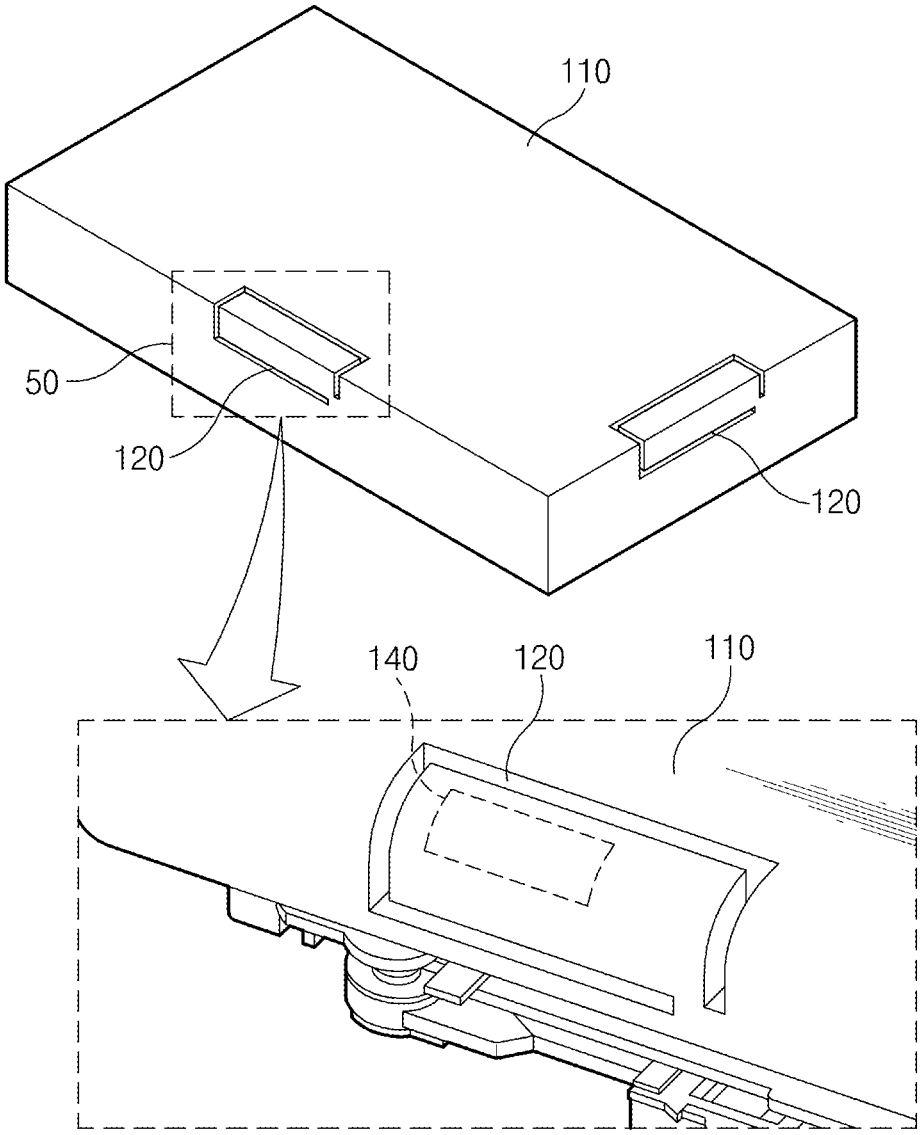
FIG. 7 is a view illustrating an enlarged portion of an antenna device according to various embodiments of the present disclosure.

FIG. 7 is a view illustrating an enlarged portion of an antenna device according to various embodiments of the present disclosure.

Referring to FIG. 7, an enlarged area 50 of an antenna device is illustrated. Referring to the enlarged portion, the slit 120 may be formed in an area of the base plate 110. According to an embodiment of the present disclosure, the slit 120 may be filled with a nonconductive filler. According to an embodiment of the present disclosure, the base plate 110 may be connected to the ground plane.

The antenna device 100 may include a feeding part 140 for supplying current to an inner area surrounded by the slit 120. The feeding part 140 may be disposed below an area surrounded by the slit 120.

According to an embodiment of the present disclosure, the feeding part 140 may be directly connected to an area surrounded by the slit 120 and supply current thereto. For example, the feeding part 140 may be implemented with a C-clip (not shown) that is directly connected to an area surrounded by the slit 120.

According to an embodiment of the present disclosure, the feeding part 140 may indirectly feed power to an area surrounded by the slit 120, with the feeding part 140 being spaced apart from an area surrounded by the slit 120. For example, the feeding part 140 may include feeding objects spaced a predetermined interval from each other and disposed below an area surrounded by the slit 120 and a feeding line connected to the feeding objects to supply current thereto. The feeding objects may feed power to an area surrounded by the slit 120 through a coupling feeding method.

When current is supplied by the feeding part 140, the antenna device 100 may operate as an antenna of a planar inverted F antenna (PIFA) structure. For example, an area surrounded by the slit 120 may correspond to a patch of a PIFA antenna, the open portion 20 of FIGS. 1A to 1C may correspond to a short-circuit pin of a PIFA antenna, the base plate 110 may correspond to the ground of a PIFA antenna, and the feeding part 140 may correspond to a feeding part of a PIFA antenna.

According to an embodiment of the present disclosure, when current is supplied by the feeding part 140, an area surrounded by the slit 120 and the slit 120 (Or the filler 130 if the slit 120 is filled with it) may serve as a radiator in the antenna device 100. According to an embodiment of the present disclosure, in relation to the antenna 100, as radiation characteristics by an area surrounded by the slit 120 and radiation characteristics by the slit 120 are combined, the radiation characteristics or resonance frequency of the antennal device 100 may be determined.

According to an embodiment of the present disclosure, when the feeding part 140 feeds power through an indirect feeding method, radiation characteristics by a feeding object are combined so that the radiation characteristics or resonance frequency of the antennal device 100 may be determined.

Figure 8A:
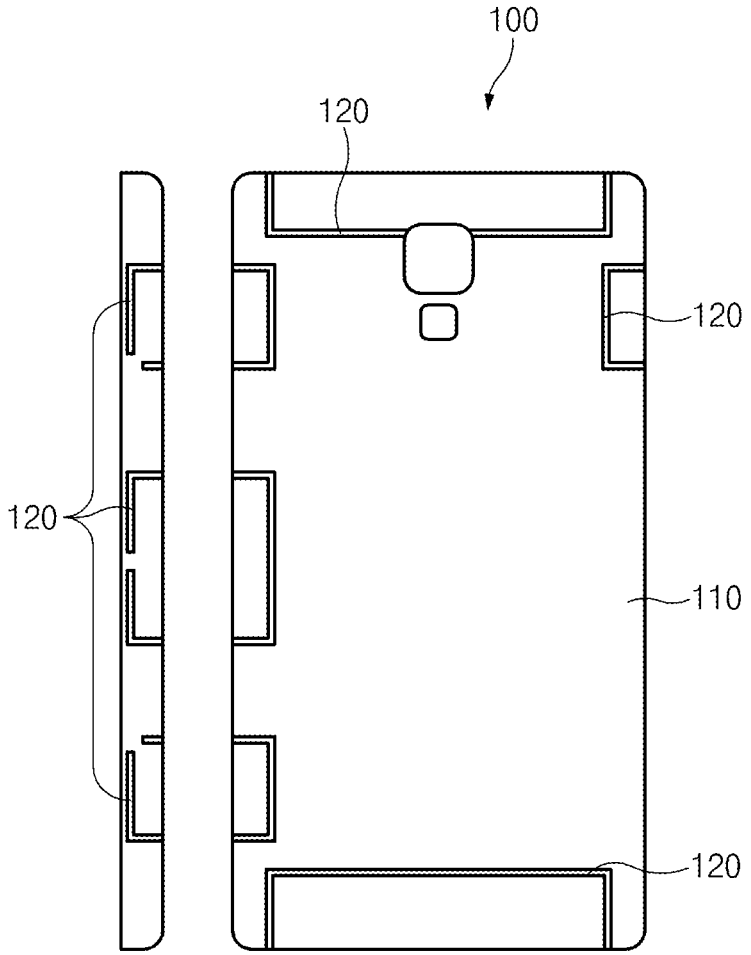
FIGS. 8A and 8B are views illustrating the form of a slit according to various embodiments of the present disclosure.
Figure 8B:
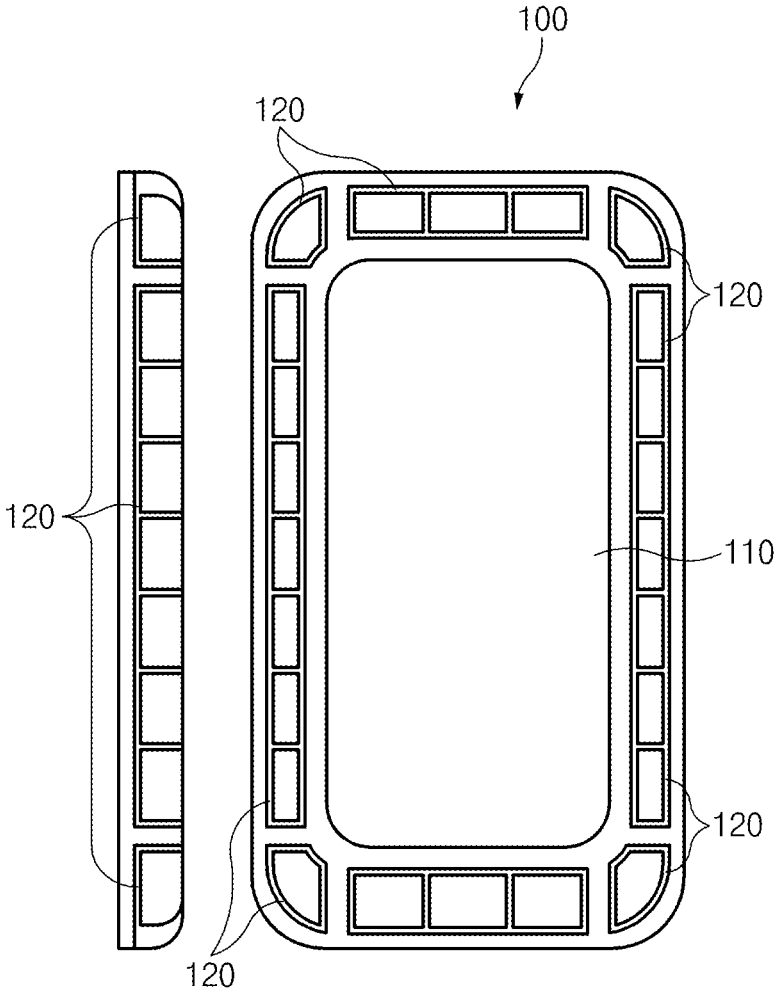

FIGS. 8A and 8B are views illustrating the form of a slit according to various embodiments of the present disclosure.

Referring to FIGS. 8A and 8B, the base plate 110 may include a plurality of slits 120.

Referring to FIG. 8A, the plurality of slits 120 may be separately formed on the base plate 110. According to an embodiment of the present disclosure, in relation to the antenna device 100, a plurality of slits 120 may be separately formed at the base plate 110 in order to have various bandwidths required by various services (for example, global positioning system (GPS), wireless fidelity (WiFi), bluetooth (BT)). According to an embodiment of the present disclosure, the antenna device 100 may include a plurality of feeding parts for respectively supplying current to the plurality of slits 120.

According to an embodiment of the present disclosure, the base plate 110 may include a dummy slit (or, a dummy filler). The dummy slit is identical to the slit 120 in terms of appearance but does not affect an antenna function and is formed for design integration. For example, the dummy slit may be formed by printing the same material as the filler 130 on the surface of the base plate 110 or may be formed by engraving the surface of the base plate 110 and filling it with the filler 130. For example, some slits shown in FIG. 8B may correspond to dummy slits.

Figure 9A:
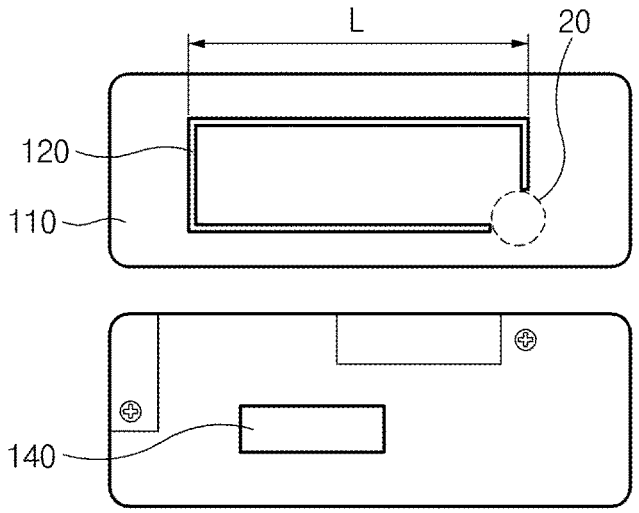
FIGS. 9A and 9B are views illustrating an experimental example for measuring radiation characteristics by using an antenna device structure of an antenna device according to various embodiments of the present disclosure.
Figure 9B:
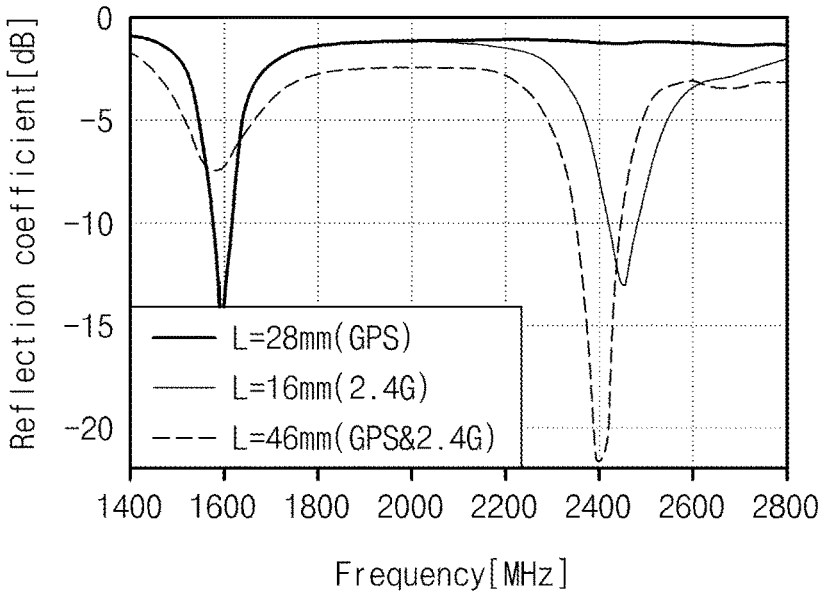

FIGS. 9A and 9B are views illustrating an experimental example for measuring radiation characteristics by using an antenna device structure of an antenna device according to various embodiments of the present disclosure.

Referring to FIG. 9A, a base plate 110 and a slit 120 are formed at the base plate 110 are shown. Referring to FIG. 9B, a result obtained by measuring a reflection coefficient is illustrated based on varying the length L in a horizontal direction of the slit 120 shown in FIG. 9A. When the length of the slit 120 is 16 mm, a resonance frequency was formed at 2.4 GHz. When the length of the slit 120 is 28 mm, a resonance frequency was formed at 1.6 GHz. When the length of the slit 120 is 46 mm, a resonance frequency was formed at 1.6 GHz and 2.4 GHz. According to an embodiment of the present disclosure, a resonance frequency of 1.6 GHz may be used for GPS service and a resonance frequency of 2.4 GHz may be used for WiFi service.

According to various embodiments of the present disclosure, an antenna device may include a base plate of a conductive material, at least one slit formed in at least one area of the base plate and having a form in which a portion of a closed curve is open, and a feeding part for supplying current to an inner area surrounded by the slit.

According to various embodiments of the present disclosure, an antenna device may include a base plate formed of a conductive material and including a penetration area, a radiator inserted into the penetration area as being spaced from the base plate, a connection part connecting the base plate and the radiator, and a feeding part for supplying current to the radiator.

Figure 10:
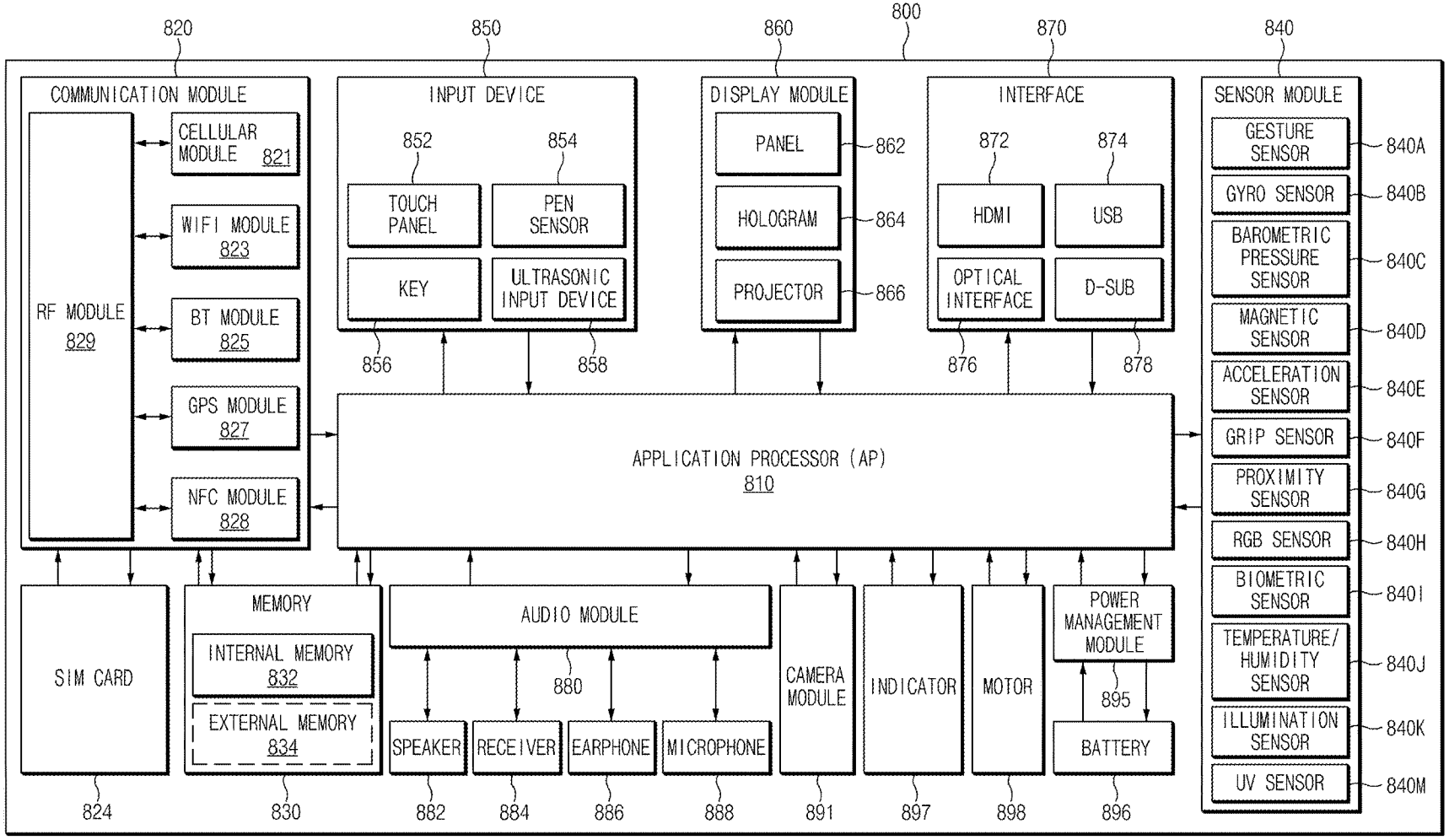
FIG. 10 is a view illustrating an electronic device including an antenna device according to various embodiments of the present disclosure.

FIG. 10 is a view illustrating an electronic device including an antenna device according to various embodiments of the present disclosure.

Referring to FIG. 10 is a block diagram of an electronic device 800 according to various embodiments of the present disclosure. The electronic device 800 may include an antenna device 100, for example. Referring to FIG. 10, the electronic device 800 may include application processor (AP) 810, a communication module 820, a subscriber identification module (SIM) card 824, a memory 830, a sensor module 840, an input device 850, a display 860, an interface 870, an audio module 880, a camera module 891, a power management module 895, a battery 896, an indicator 897, and a motor 898.

The AP 810 may control a plurality of hardware or software components connected to the AP 810 and also may perform various data processing and operations with multimedia data by executing an operating system or an application program. The AP 810 may be implemented with a system on chip (SoC), for example. According to an embodiment of the present disclosure, the AP 810 may further include a graphic processing unit (GPU) (not shown).

The communication module 820 may perform data transmission/reception between the electronic device 800 and other electronic devices connected via network or direct connection. According to an embodiment of the present disclosure, the communication module 820 may include a cellular module 821, a WiFi module 823, a BT module 825, a GPS module 827, a near field communication (NFC) module 828, and a radio frequency (RF) module 829.

According to an embodiment of the present disclosure, the communication module 820 may include an antenna 100. According to an embodiment of the present disclosure, the antenna device 100 may correspond to an antenna included in the communication module 820 in order for transmitting/receiving various signals. When the antenna device 100 is implemented with an antenna included in the communication module 820, it may receive signals transmitted from an external device and deliver them to the communication module 820 and also may radiate various signals inputted from the communication module 820 to the outside.

The cellular module 821 may provide voice calls, video calls, text services, or internet services through a communication network (for example, long term evolution (LTE), LTE-advanced (LTE-A), code division multiple access (CDMA), wideband CDMA (WCDMA), universal mobile telecommunications system (UMTS), wireless broadband (WiBro), or global system for mobile communications (GSM)). Additionally, the cellular module 821 may perform a distinction and authentication operation on an electronic device in a communication network by using a SIM (for example, the SIM card 824), for example. According to an embodiment of the present disclosure, the cellular module 821 may perform at least part of a function that the AP 810 provides. For example, the cellular module 821 may perform at least part of a multimedia control function.

According to an embodiment of the present disclosure, the cellular module 821 may further include a communication processor (CP). Additionally, the cellular module 821 may be implemented with SoC, for example. As shown in FIGS. 8A and 8B, components such as the cellular module 821 (for example, a CP), the memory 830, or the power management module 895 are separated from the AP 810, but according to an embodiment of the present disclosure, the AP 810 may be implemented including some of the above-mentioned components (for example, the cellular module 821).

According to an embodiment of the present disclosure, the AP 810 or the cellular module 821 (for example, a CP) may load instructions or data, which are received from a nonvolatile memory or at least one of other components connected thereto, into a volatile memory and then may process them. Furthermore, the AP 810 or the cellular module 821 may store data received from or generated by at least one of other components in a nonvolatile memory.

Each of the WiFi module 823, the BT module 825, the GPS module 827, and the NFC module 828 may include a processor for processing data transmitted/received through a corresponding module. Although the cellular module 821, the WiFi module 823, the BT module 825, the GPS module 827, and the NFC module 828 are shown as separate blocks in FIGS. 8A and 8B, according to an embodiment of the present disclosure, some (for example, at least two) of the cellular module 821, the WiFi module 823, the BT module 825, the GPS module 827, and the NFC module 828 may be included in one integrated chip (IC) or an IC package. For example, at least some (for example, a CP corresponding to the cellular module 821 and a WiFi processor corresponding to the WiFi module 823) of processors respectively corresponding to the cellular module 821, the WiFi module 823, the BT module 825, the GPS module 827, and the NFC module 828 may be implemented with one SoC.

The RF module 829 may be responsible for data transmission, for example, the transmission of an RF signal. Although not shown in the drawings, the RF module 829 may include a transceiver, a power amp module (PAM), a frequency filter, or a low noise amplifier (LNA). Additionally, the RF module 829 may further include components for transmitting/receiving electromagnetic waves on a free space in a wireless communication, for example, conductors or conducting wires. Although the cellular module 821, the WiFi module 823, the BT module 825, the GPS module 827, and the NFC module 828 share one RF module 829 shown in FIG. 8, according to an embodiment of the present disclosure, at least one of the cellular module 821, the WiFi module 823, the BT module 825, the GPS module 827, and the NFC module 828 may perform the transmission/reception of an RF signal through an additional RF module.

The SIM card 824 may be a card including a SIM and may be inserted into a slot formed at a specific position of an electronic device. The SIM card 824 may include unique identification information (for example, an integrated circuit card identifier (ICCID)) or subscriber information (for example, an international mobile subscriber identity (IMSI)).

The memory 830 may include an internal memory 832 or an external memory 834. The internal memory 832 may include at least one of a volatile memory (for example, dynamic random access memory (DRAM), static RAM (SRAM), synchronous DRAM (SDRAM)) and a non-volatile memory (for example, one time programmable read only memory (OTPROM), programmable ROM (PROM), erasable and programmable ROM (EPROM), electrically erasable and programmable ROM (EEPROM), mask ROM, flash ROM, not and (NAND) flash memory, and not or (NOR) flash memory).

According to an embodiment of the present disclosure, the internal memory 832 may be a solid state drive (SSD). The external memory 834 may further include flash drive, for example, compact flash (CF), secure digital (SD), micro-SD, mini-SD, extreme digital (xD), or a memory stick. The external memory 834 may be functionally connected to the electronic device 800 through various interfaces. According to an embodiment of the present disclosure, the electronic device 800 may further include a storage device (or a storage medium) such as a hard drive.

The sensor module 840 measures physical quantities or detects an operating state of the electronic device 800, thereby converting the measured or detected information into electrical signals. The sensor module 1840 may include at least one of a gesture sensor 840A, a gyro sensor 840B, a barometric pressure sensor 840C, a magnetic sensor 840D, an acceleration sensor 840E, a grip sensor 840F, a proximity sensor 840G, a color sensor 840H (for example, a red, green, blue (RGB) sensor), a biometric sensor 840I, a temperature/humidity sensor 840J, an illumination sensor 840K, and an ultraviolet (UV) sensor 840M. Additionally or alternatively, the sensor module 840 may include an E-nose sensor (not shown), an electromyography (EMG) sensor, an electroencephalogram (EEG) sensor (not shown), an electrocardiogram (ECG) sensor (not shown), an infrared (IR) sensor (not shown), an iris sensor (not shown), or a fingerprint sensor (not shown). The sensor module 840 may further include a control circuit for controlling at least one sensor therein.

The input device 850 may include a touch panel 852, a (digital) pen sensor 854, a key 856, or an ultrasonic input device 858. The touch panel 852 may recognize a touch input through at least one of capacitive, resistive, infrared, or ultrasonic methods, for example. Additionally, the touch panel 852 may further include a control circuit. In the case of the capacitive method, both direct touch and proximity recognition are possible. The touch panel 852 may further include a tactile layer. In this case, the touch panel 852 may provide a tactile response to a user.

The (digital) pen sensor 854 may be implemented through a method similar or identical to that of receiving a user's touch input or an additional sheet for recognition. The key 856 may include a physical button, an optical key, or a keypad, for example. The ultrasonic input device 858, as a device checking data by detecting sound waves through a microphone (for example, a microphone 888) in the electronic device 800, may provide wireless recognition through an input tool generating ultrasonic signals. According to an embodiment of the present disclosure, the electronic device 800 may receive a user input from an external device (for example, a computer or a server) connected thereto through the communication module 820.

The display 860 may include a panel 862, a hologram device 864, or a projector 866. The panel 862 may include a liquid-crystal display (LCD) or an active-matrix organic light-emitting diode (AM-OLED). The panel 862 may be implemented to be flexible, transparent, or wearable, for example. The panel 862 and the touch panel 852 may be configured as one module. The hologram 864 may show three-dimensional images in the air by using the interference of light. The projector 866 may display an image by projecting light on a screen. The screen, for example, may be placed inside or outside the electronic device 800. According to an embodiment of the present disclosure, the display 860 may further include a control circuit for controlling the panel 862, the hologram device 864, or the projector 866.

The interface 870 may include a high-definition multimedia interface (HDMI) 872, a universal serial bus (USB) 874, an optical interface 876, or a D-subminiature (D-sub) 878, for example. Additionally or alternatively, the interface 870 may include a mobile high-definition link (MHL) interface, an SD card/multi-media card (MMC) interface, or an infrared data association (IrDA) standard interface.

The audio module 880 may convert sound into electrical signals and convert electrical signals into sounds. The audio module 880 may process sound information inputted/outputted through a speaker 882, a receiver 884, an earphone 886, or a microphone 888.

The camera module 891, as a device for capturing a still image and a video, may include at least one image sensor (for example, a front sensor or a rear sensor), a lens (not shown), an image signal processor (ISP) (not shown), or a flash (not shown) (for example, an LED or a xenon lamp).

The power management module 895 may manage the power of the electronic device 800. Although not shown in the drawings, the power management module 895 may include a power management IC (PMIC), a charger IC, or a battery or fuel gauge, for example.

The PMIC may be an IC or SoC semiconductor, for example. A charging method may be classified into a wired method and a wireless method. The charger IC may charge a battery and may prevent overvoltage or overcurrent flow from a charger. According to an embodiment of the present disclosure, the charger IC may include a charger IC for at least one of a wired charging method and a wireless charging method. As the wireless charging method, for example, there is a magnetic resonance method, a magnetic induction method, or an electromagnetic method. An additional circuit for wireless charging, for example, a circuit such as a coil loop, a resonant circuit, or a rectifier circuit, may be added.

The battery gauge may measure the remaining amount of the battery 896, or a voltage, current, or temperature thereof during charging. The battery 896 may store or generate electricity and may supply power to the electronic device 800 by using the stored or generated electricity. The battery 896, for example, may include a rechargeable battery or a solar battery.

The indicator 897 may display a specific state of the electronic device 800 or part thereof (for example, the AP 810), for example, a booting state, a message state, or a charging state. The motor 898 may convert electrical signals into mechanical vibration. Although not shown in the drawings, the electronic device 800 may include a processing device (for example, a GPU) for mobile television (TV) support. A processing device for mobile TV support may process media data according to the standards such as digital multimedia broadcasting (DMB), digital video broadcasting (DVB), or mediaFLO.

According to various embodiments of the present disclosure, the rigidity of an electronic device may be obtained by maximizing an external metallic area of the electronic device and simultaneously, the antenna performance may be obtained.

Each of the above-mentioned components of the electronic device according to various embodiments of the present disclosure may be configured with at least one component and the name of a corresponding component may vary according to the kind of an electronic device. An electronic device according to various embodiments of the present disclosure may include at least one of the above-mentioned components, may not include some of the above-mentioned components, or may further include another component. Additionally, some of components in an electronic device according to various embodiments of the present disclosure are configured as one entity, so that functions of previous corresponding components are performed identically.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna device in an electronic device having a display disposed on a top surface, the antenna device comprising:

a base plate of a conductive material covering a bottom surface of the electronic device, the base plate comprising a first removed region to form a first antenna integral to the base plate; and a feeding part connected to an interior surface of the first antenna and configured to supply current to the first antenna, wherein the first removed region has a form in which a portion of a closed curve is open, wherein the first antenna corresponds to an inner area of the closed curve and electrically connects to the base plate through an opened portion, wherein the opened portion corresponds to a short-circuit pin of a planar inverted F antenna (PIFA), wherein the base plate further covers a side surface extending from the bottom surface and a top surface extending from the side surface, wherein the first removed region is formed in the bottom surface, the side surface and the top surface, and wherein the top surface is substantially planar with respect to the bottom surface.

2. The antenna device of claim 1, further comprising a nonconductive filler disposed in the first removed region.

3. The antenna device of claim 1, wherein the base plate further comprises a second removed region to form a second antenna integral to the base plate.

4. The antenna device of claim 3, wherein the second removed region is a form in which a portion of a closed curve is open and a first end of the first removed region is connected to a first end of the second removed region.

5. The antenna device of claim 4, wherein the first removed region and the second removed region are symmetric to each other with respect to an axis.

6. The antenna device of claim 5, wherein the opened portion of the first removed region and the opened portion of the second removed region face each other.

7. The antenna device of claim 4, wherein the first removed region is rotated 180° from the second removed region.

8. The antenna device of claim 4, wherein a width of the first removed region and a width of the second removed region are different.

9. The antenna device of claim 4, wherein the first removed region and the second removed region have open portions in different directions.

10. An antenna device in an electronic device having a display disposed on a top surface, the antenna device comprising:

a base plate of a conductive material covering a bottom surface of the electronic device, the base plate including a penetration area;

a radiator configured to be inserted into the penetration area and being spaced apart from the base plate;

a nonconductive filler disposed between the base plate and the radiator to electrically isolate the radiator from the base plate;

a connection part configured to electrically connect the base plate and the radiator; and a feeding part connected to an interior surface of the radiator and configured to supply current to the radiator, wherein the connection part corresponds to a short-circuit pin of a planar inverted F antenna (PIFA), wherein the base plate further covers a side surface extending from the bottom surface and a top surface extending from the side surface, wherein the penetration area and the radiator are formed in the bottom surface, the side surface and the top surface, and wherein the top surface is substantially planar with respect to the bottom surface.

11. The antenna device of claim 10, wherein the base plate forms a low voltage potential plane.

12. An electronic device for wireless communication, the electronic device comprising:

a base plate covering a bottom surface of the electronic device, the base plate comprising a first removed region to form a first antenna integral to the base plate, wherein a nonconductive filler material is disposed in the first removed region to electrically isolate the first antenna from the base plate;

at least one processor configured to control the operation of the electronic device;

a feeding part connected to an interior surface of the first antenna and configured to supply current to the first antenna; and a display disposed on a top surface of the electronic device, wherein the first removed region has a form in which a portion of a closed curve is open, wherein the first antenna corresponds to an inner area of the closed curve and electrically connects to the base plate through an opened portion, wherein the opened portion includes a short-circuit pin of a planar inverted F antenna (PIFA), wherein the base plate further covers a side surface extending from the bottom surface and a top surface extending from the side surface, wherein the first removed region is formed in the bottom surface, the side surface and the top surface, and wherein the top surface is substantially planar with respect to the bottom surface.

13. The electronic device of claim 12, wherein the base plate further comprises a second removed region to form a second antenna integral to the base plate, wherein the second removed region has a form in which a portion of a closed curve is open.

* * * * *